US011396978B2

(12) United States Patent
Evangelisti

(10) Patent No.: US 11,396,978 B2
(45) Date of Patent: Jul. 26, 2022

(54) REFUELLING METHOD AND DEVICE FOR SUPPLYING LIQUEFIED GASES AND THE LIKE

(71) Applicant: GAS AND HEAT S.P.A., Leghorn (IT)

(72) Inventor: Federico Evangelisti, Leghorn (IT)

(73) Assignee: GAS AND HEAT S.P.A., Leghorn (IT)

( * ) Notice: Subject to any disclaimer, the term of this patent is extended or adjusted under 35 U.S.C. 154(b) by 163 days.

(21) Appl. No.: 16/651,894

(22) PCT Filed: Sep. 26, 2018

(86) PCT No.: PCT/IB2018/057431

§ 371 (c)(1),
(2) Date: Mar. 27, 2020

(87) PCT Pub. No.: WO2019/064189

PCT Pub. Date: Apr. 4, 2019

(65) Prior Publication Data

US 2021/0364128 A1 Nov. 25, 2021

(30) Foreign Application Priority Data

Sep. 29, 2017 (IT) ..... 102017000109469

(51) Int. Cl.
*F17C 5/02* (2006.01)

(52) U.S. Cl.
CPC ..... *F17C 5/02* (2013.01); *F17C 2205/0338* (2013.01); *F17C 2221/033* (2013.01); *F17C 2223/0161* (2013.01); *F17C 2227/0135* (2013.01); *F17C 2250/0434* (2013.01); *F17C 2265/037* (2013.01); *F17C 2270/0105* (2013.01)

(58) Field of Classification Search
CPC ..... F17C 5/02; F17C 2205/0338; F17C 2221/033; F17C 2223/0161; F17C 2227/0135; F17C 2250/0434; F17C 2265/037; F17C 2270/0105
USPC ..... 62/5
See application file for complete search history.

(56) References Cited

U.S. PATENT DOCUMENTS

| | | | | |
|---|---|---|---|---|
| 5,393,202 | A * | 2/1995 | Levallois | E21B 43/12 417/19 |
| 6,012,482 | A | 1/2000 | Nelson et al. | |
| 2002/0104581 | A1 | 8/2002 | Drube et al. | |
| 2002/0170297 | A1 | 11/2002 | Quine et al. | |
| 2008/0148740 | A1 * | 6/2008 | Hartono | B63B 27/24 62/50.1 |
| 2015/0362128 | A1 | 12/2015 | Sanglan et al. | |

* cited by examiner

*Primary Examiner* — Timothy P. Kelly
*Assistant Examiner* — Christopher M Afful
(74) *Attorney, Agent, or Firm* — Vorys, Sater, Seymour and Pease LLP; Anthony Venturino

(57) ABSTRACT

A refuelling device for supplying liquefied gas is provided, including a feed system adapted to place each reservoir in fluidic through connection with a tank and including withdrawal ducts for withdrawing the liquefied gas from the reservoirs; an inlet duct for introducing the liquefied gas into the tank; a collection manifold for conveying the withdrawal ducts into the inlet duct; a pump adapted to move the liquefied gas in the feed system; and a pressure gauge to measure the inlet pressure of the liquefied gas in the pump; and a valve adapted to regulate the flow in the inlet duct according to the inlet pressure.

2 Claims, 1 Drawing Sheet

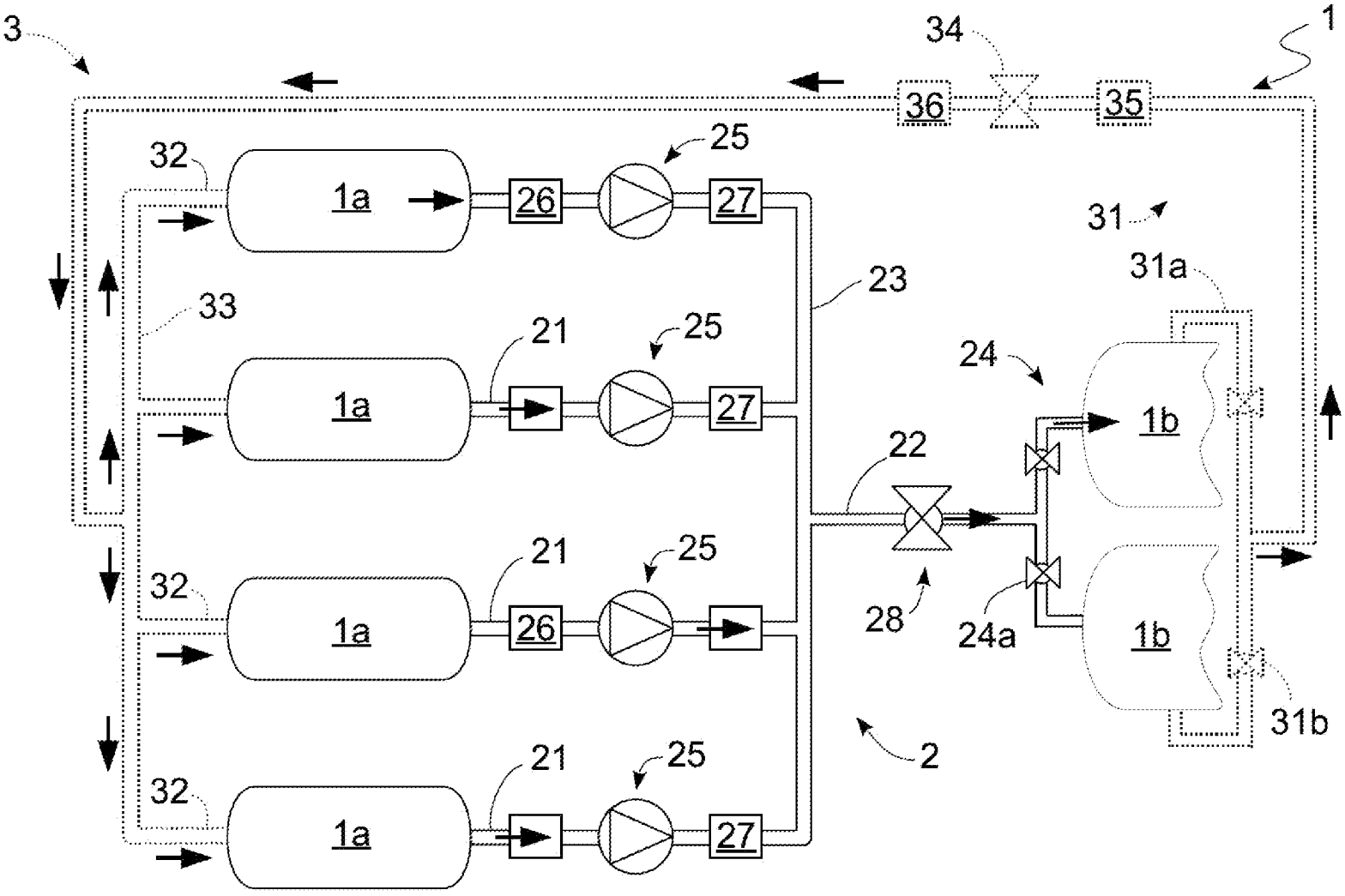
1
35
34
36
31
31a
31b
1b
1b
24
24a
22
28
2
23
25
27
26
21
1a
32
33
3

REFUELLING METHOD AND DEVICE FOR SUPPLYING LIQUEFIED GASES AND THE LIKE

The present invention relates to a refuelling method and device for supplying liquefied gases and the like of the type as recited in the preamble of the independent claims.

In particular, the invention relates to a method and device for supplying LNG, i.e. liquefied natural gas. It is suitable to allow the refuelling of a vehicle such as preferably a ship.

As is well known, ship refuelling requires a tanker truck filled with LNG to be positioned on a quay near the ship to be refuelled; the connection of the reservoir to the tank of the ship and then the LNG feeding by a pump from the reservoir into the tank.

The prior art described above has some notable drawbacks.

A first important drawback lies in the fact that several reservoirs have to be used to fill a ship. In detail, this filling process involves the sequential use of reservoirs in order to avoid problems related to the flow of LNG and in particular to the pump operation control.

Therefore, the process is slow and particularly expensive.

Another important drawback is that, due to the tank emptying (with a consequent risk of pump cavitation) and/or the tank filling (with an increased duration of the operation), the conditions of the fluids in the reservoir and/or in the tank evolve constantly, thus making the pump regulation process very complex.

To overcome these problems, the reservoirs are provided with a vaporizer that draws LNG from the reservoir, vaporizes it and introduces it into the reservoir, by counterbalancing the pressure lowering.

However, the amount of steam produced by the vaporizer does not allow to rebalance the pressure loss due to the emptying of the reservoir, and it does not overcome this problem definitively.

In addition, the amount of vaporized LNG is not introduced into the tank and is therefore lost, which leads to increasing costs.

It should be noted that the drawback mentioned above is amplified by the operator's difficulties in managing the different pressures in the reservoirs.

In this context, the technical task underlying the present invention is to develop a refuelling method and device for supplying liquefied gases, able to substantially overcome at least some of the drawbacks mentioned above.

Within the sphere of said technical task one important aim of the invention is to provide a refuelling method and device for supplying liquefied gases, that is simple to control, fast and inexpensive.

The technical task and the specified aims are achieved with a refuelling method and device for supplying liquefied gases as claimed in the appended independent claims. Examples of preferred embodiments are described in the dependent claims.

Preferred embodiments are set forth in the dependent claims.

The features and advantages of the invention will be apparent from the following detailed description of preferred embodiments thereof, with reference to FIG. 1 showing a diagram of the device for supplying liquefied gases according to the invention.

Herein, the measures, values, shapes and geometric references (such as perpendicularity and parallelism), when used with words like "about" or other similar terms such as "approximately" or "substantially", are to be understood as except for measurement errors or inaccuracies due to production and/or manufacturing errors and, above all, except for a slight divergence from the value, measure, shape or geometric reference which it is associated with. For example, these terms, if associated with a value, preferably indicate a divergence of not more than 10% from said value.

Furthermore, when used, terms such as "first", "second", "higher", "lower", "main" and "secondary" do not necessarily identify an order, a priority relationship or a relative position, but can simply be used to distinguish more clearly the different components from each other.

Unless otherwise indicated, the measurements and data provided in this document are to be considered using International Standard Atmosphere ICAO (ISO 2633). Unless otherwise specified, as is apparent from the following discussion, terms such as "treatment", "data processing", "determination", "calculation", or the like, are understood to refer to the action and/or processes of a computer or similar electronic computing device which manipulates and/or transforms data represented as physical, such as electronic sizes of registers of a computer system and/or memories, into other data similarly represented as physical quantities in computer systems, registers or other storage, transmission or information display devices.

With reference to the Figures, reference numeral 1 globally denotes the device for supplying liquefied gases according to the invention.

The term liquefied gases identifies all liquids obtained by liquefaction of a gas, suitably combustible, so as to reduce, even by 600 times, the specific volume thereof, compared to standard conditions. In order to keep the gas in the liquid phase, the liquefied gas is stored at a liquefaction temperature (usually −160° C.) which is lower than the ambient temperature (the temperature at which the gas is in the gas phase).

The liquefied gas is preferably LNG.

The refuelling device 1 is adapted to use at least one refuelling reservoir 1*a* containing the liquefied gas to refuel one or more tanks 1*b*, usually one or two tanks 1*b*.

Preferably the refuelling device 1 is suitable to use more than one reservoirs 1*a*, in particular working in parallel, to refuel simultaneously one or more tanks 1*b* (for example one or two).

Preferably the reservoirs 1*a* are between three and seven, more preferably four. One or more reservoirs 1*a* can be static, i.e. integrally fastened to the ground; and/or mobile and, for example, moveable by truck.

The tank 1*b* can be the tank of a vehicle and in particular of a ship.

If several tanks 1*b* are connected to the device 1, the tanks 1*b* may be part of a single vehicle, and in particular of a single ship, or of several vehicles, and in particular of several ships.

The refuelling device 1 comprises a fluid feed system 2 from the at least one reservoir 1*a* to the at least one tank 1*b*; and preferably a pressurisation system 3 of the one or more reservoirs 1*a*.

The feed system 2 is adapted to place at least a reservoir 1*a* in fluidic through connection with the at least one tank 1*b* thereby allowing the liquefied gas to pass from said at least one reservoir 1*a* to said at least one tank 1*b*.

Preferably, the feed system 2 is adapted to place a plurality of reservoirs 1*a*, appropriately four, in fluidic through connection with the at least one tank 1*b* at the same time so that the liquefied gas passes simultaneously from each reservoir 1*a* to one or more tanks 1*b*.

The feed system 2 may comprise, for each reservoir 1*a*, a withdrawal duct 21 for withdrawing liquefied gas from said reservoir 1*a*.

The feed system 2 may comprise, for each reservoir 1*b*, an inlet duct 22, preferably only one, of the liquefied gas to the reservoir 1*b*.

In the case of one withdrawal duct 21 and one inlet duct 22, the ducts 21 and 22 are in direct fluidic through connection so that the liquefied gas passes from the withdrawal duct 21 directly to the inlet duct 22. In this case, the ducts 21 and 22 can identify only one duct.

In the case of several withdrawal ducts 21 (i.e. several reservoirs 1*a*), the feed system 2 may comprise a collection manifold 23 placing the withdrawal ducts 21 simultaneously in fluidic through connection with the inlet duct 22, thus placing the reservoirs 1*a* in parallel.

The collection manifold 23 is then adapted to convey the liquefied gas exiting from the withdrawal ducts 21 into the inlet duct 22. It is interposed between the ducts 21 and 22.

In the case of several tanks 1*b*, the feed system 2 may comprise a distributor 24 placing the inlet duct 22 simultaneously in fluidic through connection with the tanks 1*b*.

The distributor 24 can be provided with a flow regulating device 24*a* for each tank 1*b*.

The flow regulating device 24*a* is adapted to regulate the flow entering a tank 1*b*, for example, by allowing the device 1 to refuel or not the tank 1*b* connected to it. The flow regulating device 24*a* can be external to the device 1 and part of a tank 1*b*.

The feed system 2 may comprise at least one pump 25 adapted to move the liquefied gas in the feed system 2 and, therefore, from the at least one reservoir 1*a* to the tank 1*b*.

In the case of several reservoirs 1*a* the at least one pump 25 is adapted to simultaneously control the withdrawal of liquefied gas from all reservoirs 1*a* which are then emptied in parallel.

In detail, the feed system 2 may comprise one pump 25 suitably integrated in the inlet duct 22. It is suitable for withdrawing the liquefied gas simultaneously from the reservoirs 1*a* as it is located downstream of the manifold 23.

In this document, the terms "downstream" and "upstream" refer to the direction of advancement of the liquefied gas in the feed system 2 and of the filling gas (described below) in the pressurisation system 3.

Alternatively, the feed system 2 may comprise a plurality of pumps 25, one for each withdrawal duct 21, such pumps being suitable to operate in parallel so as to withdraw the liquefied gas simultaneously from the reservoirs 1*a*.

Each pump 25 is integrated in the withdrawal duct 21.

Preferably the operating parameters of the pumps 25 are identical.

Since said pumps 25 are simultaneously in fluidic through connection with a single inlet duct 22, they define substantially the same outlet pressure. Each pump 525 mutually influences the output pressure (described below) of all other pumps 25.

Preferably the pumps 25 are the only pumps of the device 1.

The feed system 2 may comprise for each pump 25*a* pressure gauge 26 for the inlet pressure of the liquefied gas in the pump 25.

The pressure gauge 26 is upstream of the pump 25. It is adapted to be interposed between the pump 25 and the reservoir 1*a*.

It should be noted that, being measured upstream of the pump 25, the inlet pressure can substantially correspond to that of the reservoir 1*a*.

The pressure gauge 26 can be used to measure said inlet pressure of the liquefied gas in the inlet duct 22. It is integrated in the inlet duct 22 (in the case of a single pump 25).

Alternatively, the pressure gauge 26 can be adapted to measure the inlet pressure in the withdrawal duct 21. It is then integrated into the withdrawal duct 21. In particular, in the case of several pumps 25, the feed system 2 may comprise several gauges 26, one for each withdrawal duct 21.

The feed system 2 may comprise at least one pressure meter 27 for the outlet pressure of the liquefied gas exiting from at least one pump 25.

The pressure meter 27 is downstream of the pump 25. It is therefore suitable for interposing between the pump 25 and the tank 1*b*.

The feed system 2 may comprise only one pressure meter 27 adapted to measure the outlet pressure in the inlet duct 22. It is integrated in the inlet duct 22.

Alternatively, the feed system 2 may comprise several pressure meters 27. Each of them is adapted to measure said outlet pressure in a withdrawal duct 21 downstream of said pump 25 and then integrated in a withdrawal duct 21 (FIG. 1). The feed system 2 may comprise at least one regulating valve 28 to regulate, suitably automatically, the flow of liquefied gas in at least the inlet duct 22 according to the inlet and/or outlet pressure and preferably to their difference.

The regulating valve 28 is downstream of the pump 25 and preferably of the pressure meter 27.

The feed system 2 may comprise several regulating valves 28, each integrated in a withdrawal duct 21 and adapted to regulate the flow of liquefied gas in a withdrawal duct 21 and consequently in the collection manifold 23 and in the inlet duct 22.

Preferably, the feed system 2 comprises only one regulating valve 28 integrated in the inlet duct 22.

The regulating valve 28 is adapted to regulate the operation of pump 25, keeping it in the optimal operating range/curve.

In particular, it is adapted to adjust the flow downstream of the pump 25, thus maintaining a constant difference between the outlet and inlet pressure. In accordance with said difference between the outlet and inlet pressures, the regulating valve 28 provides operating parameters for the pump 25 so as to keep it within the optimal operating range.

Preferably the regulating valve 28 is adapted to adjust the operating parameters of the pumps 25 keeping them equal to each other.

In FIG. 1 the pressurization system 3 is shown—unlike the adduction system 2—with a dotted line to facilitate the distinction between the two systems 2 and 3.

The pressurisation system 3 is adapted to operate by counteracting the lowering of the pressure in the reservoir 1*a* due to the withdrawal of liquefied gas, preferably by keeping the pressure in the reservoir 1*a* almost constant during refuelling.

In particular, it is adapted to increase the pressure in one or more reservoirs 1*a* with a pressure lower than at least one tank 1*b*.

The pressurisation system 3 can be adapted to perform this function by introducing into the reservoir 1*a* a filling gas, suitably steam.

The pressurisation system 3 may comprise a return line 31 adapted to withdraw the filling gas, for example, from an external apparatus such as a cylinder/external circuit of natural gas or other filling gas, preferably an inert gas.

The pressurisation system 3 may comprise, for each reservoir 1*a*, a second duct 32 adapted to carry the filling gas from the return line 31 to a reservoir 1*a*.

The second duct 32 is adapted to be placed in fluidic through connection with a reservoir 1*a*.

In the case of several reservoirs 1*a*, the pressurisation system 3 is adapted to provide parameters for the reservoirs 1*a* which are almost equal to each other. In particular, it may comprise a connecting member 33 adapted to place the reservoirs 1*a* in reciprocal fluidic through connection so as to place said reservoirs under the same pressure.

Preferably, the pressurisation system 3 is adapted to equalise the pressures of the reservoirs 1*a* by introducing a filling gas into them. It can thus comprise a return line 31; several conduits 31 (one for each reservoir 1*a*), and a connecting member 33 interposed between the return line 31 and the duct 32 so that the return line 31 is in fluidic through connection simultaneously with all the ducts 32.

The pressurization system 3 may comprise a compressor upstream of the connection member 3 so as to place the member 33 and the ducts 32 under the same pressure.

Advantageously, the pressurization system 3 is devoid of compressors, i.e. it has a natural circulation. The passage of the filling gas from the at least one tank 1*b* to said one or more reservoirs 1*a* occurs through natural circulation and it is therefore controlled by the pressure drop of the reservoirs 1*a* during refuelling.

Preferably, the filling gas is the boil-off in at least one tank 1*b* (in this document the term boil-off identifies the portion of liquefied gas in the tank 1*b* which turned to the gaseous state) and the return line 31 is adapted to be placed in fluidic through connection with said at least one tank 1*b*.

The pressurisation system 3 is adapted to place in flidic through connection said at least one tank 1*b* with said at least one reservoir 1*a*.

As a result, the inlet and outlet pressures of the pump 25 can be reduced as much as possible and in particular adjusted keeping the pump in the optimal operating field/curve.

In the case of a single tank 1*b* the return line 31 can be identified as a duct.

In the case of several tanks 1*b* the return line 31 comprises a collection body 31*a* for the filling gas (the boil-off) exiting the tanks 1*b*.

The collection body 31*a* is adapted to convey and then introduce the filling gas from the tanks 1*b* into the duct 32 in the case of one reservoir 1*a* or into the connecting member 33 in the case of several reservoirs 1*a*.

In addition, in the case of several tanks 1*b*, the return line 31 may comprise, in addition to the collection body 31*a*, means of regulation 31*b* of the gas flow exiting each tank 1*b*.

The means of regulation 31*b* are therefore only adapted to control the passage of filling gas from the tank 1*b* to the reservoir 1*a* if the pressure in the tank 1*b* exceeds a predefined threshold and in particular the pressure in at least one reservoir 1*a*.

The means of regulation 31*b* may be external to device 1 and part of a tank 1*b*.

Each duct 32 may comprise at least one closing block (not shown in the FIGURE) adapted to measure the pressure in a duct 32 and selectively allow the fluid to pass to the reservoir 1*a* only if the pressure in that reservoir 1*a* is less than tank 1*b*.

A closing block may be external to the device 1 and part of a reservoir 1*a*.

To selectively control the flow of fluid from the at least one tank 1*b* to the at least one reservoir 1*a* the pressurisation system 3 may comprise a flow control valve 34 in the pressurisation system 3.

The control valve 34 can be integrated in a duct 32 or preferably in the return line 31.

The control valve 34 can be integrated in a duct 32 or preferably in the return line 31.

It is adapted to control the fluid flow only if the filling gas pressure upstream of the control valve 34 and therefore in the tank 1*b* is higher than the filling gas pressure downstream of the control valve 34 and therefore in the reservoir 1*a*.

In order to control the opening and/or closing of the control valve 34, the pressurisation system 3 may comprise a first sensor 35 adapted to measure the filling gas pressure upstream of the control valve 34; a second sensor 36 adapted to measure the filling gas pressure downstream of the control valve 34.

The control valve 34 is therefore only adapted to control the passage of fluid if the pressure measured by the first sensor 35 is greater than the pressure measured by the second sensor 36.

The refuelling device 1 may comprise a control unit for the operation of the device 1 described below.

It is adapted to control at least one regulating valve 28 and/or at least one pump 23 preferably according to the data collected by pressure gauge 26 and/or pressure meter 27 as described above.

The control unit is also adapted to control the control valve 34 according to the pressure in the reservoir 1*a* and/or in the tank 1*b*.

It comprises a PLC.

The invention comprises a new refuelling method for supplying liquefied gases preferably implemented through the refuelling device 1 described above.

This method describes the operation of the refuelling device 1.

The refuelling process is adapted to refuel at least one tank 1*b* (suitably one or two tanks 1*b*) using at least one reservoir 1*a* and preferably using several reservoirs 1*a* in parallel, simultaneously.

The refuelling process provides a refuelling step and a pressurization step.

Advantageously, the refuelling method requires that the refuelling and pressurisation steps are carried out simultaneously so that the filling gas counteracts the lowering of pressure in reservoir 1*a*.

During the refuelling step, the liquefied gas is transferred from said reservoir 1*a* to said tank 1*b*. In detail, the at least one pump 25 controls the exit from said reservoir 1*a* of the liquefied gas which thus passes through the withdrawal duct 21, the inlet duct 22 and enters the tank 1*b*.

This withdrawal of liquefied gas causes a lowering of the pressure of the reservoir 1*a*.

Simultaneously, the pressurization step takes place.

This pressurisation step takes place only if between reservoirs 1*a* and tanks 1*b* meeting the requirement of having the pressure in at least one tank 1*b* greater than that in at least one reservoir 1*a*.

In the pressurization step, the pressurization system 3 works by counteracting the lowering of the pressure in the reservoir 1*a* due to the withdrawal of liquefied gas. During the pressurisation step, a filling gas (preferably the boil-off in the at least one tank 1*b*) is introduced into the reservoir 1*a*.

At this step, the filling gas, driven by a compressor or preferably only controlled by said lowering of the pressure in reservoir 1*a*, passes through the pressurization system 3 to enter the reservoir 1*a* by counteracting the lowering of the pressure and preferably maintaining the pressure of the reservoir 1*a* substantially constant, despite the withdrawal of liquefied gas.

Advantageously, the filling gas is the boil-off which, through the pressurisation system 3, passes from the one or more tanks 1*b* to one or more reservoirs 1*a*.

The refuelling method for supplying liquefied gases is preferably adapted to refuel a tank 1*b* using several reservoirs 1*a* in parallel at the same time.

In this case, during the refuelling step, the liquefied gas is simultaneously withdrawn from all reservoirs 1*a* and transferred to the tank 1*b*; and during the pressurisation step, the filling gas (preferably the boil-off in tank 1*b*) is simultaneously introduced into all reservoirs 1*a*.

In particular, during the filling step, at least one pump 25 withdraws simultaneously a liquefied gas flow from all reservoirs 1*a*. Each flow of liquefied gases passes through a withdrawal duct 21 and reaches the collection manifold 23 where it joins the other flows, forming a single flow that enters the tank 1*b* through the inlet duct 22.

In detail, the liquefied gas flows exiting the reservoirs 1*a* are all identical.

The withdrawal step is carried out at the same time as the filling phase in which the pressures of the reservoirs 1*a* are made uniform and therefore they are made/kept substantially equal to each other.

Preferably during the filling step the filling gas (preferably the boil-off of the tank 1*b*) passes through the return line 31, divides in the connecting member 33 in sub-flows suitably equal to each other. Each sub-flow passes through a duct 32 thereby entering a reservoir 1*a*.

It should be noted that the reservoirs 1*a* show pressures which are almost equal to each other, since they all simultaneously placed in a fluidic through connection.

The refuelling method and device 1 according to the invention achieve some important advantages.

In fact, they allow to use simultaneously more reservoirs 1*a*, without complex and laborious devices, and therefore in parallel.

This aspect is increased by the possibility of regulating the flow according to the inlet and preferably outlet pressure, thus adapting the working conditions of the pump 4 to those of the liquefied gas flow. More in particular, it is obtained by keeping the difference between outlet and inlet pressure substantially constant. This aspect is also achievable thanks to the possibility to maintain the pressures of said reservoirs 1*a* substantially equal to each other and in particular constant.

In particular, this solution is made possible by using the boil-off of the tank 1*b* (currently dispersed by combustion in the environment) and then by creating, through the pressurization system 3, a second fluidic through connection (in particular, gas) between reservoirs 1*a* and tank 1*b* which can be exploited to have a flow working in parallel and counteracting the withdrawal of liquefied gas from the reservoir 1*a*.

In conclusion, the refuelling method and the device 1 allow the working conditions of the different reservoirs 1*a* to be uniform, thus making it extremely simple and inexpensive to control the flow of liquefied gas and therefore the one or more pumps 25.

This uniformity of the reservoirs 1*a* is ensured throughout the entire refuelling process.

The invention is subject to variations without departing from the scope of the inventive concept as defined in the claims. All details may be replaced with equivalent elements and the scope of the invention includes all other materials, shapes and dimensions.

The invention claimed is:

1. A refuelling method for supplying liquefied gases, which is adapted to refuel at least one tank by using at least one reservoir containing said liquefied gas, said refuelling method comprising a filling step, wherein said liquefied gas is transferred from said at least one reservoir to said at least one tank;

a pressurizing step for pressurizing said at least one reservoir, wherein the boil-off of said liquefied gas in said at least one tank is introduced into said at least one reservoir; and wherein said filling step and said pressurization step are carried out simultaneously, so that said boil-off counteracts the lowering of the pressure in said at least one reservoir caused by said filling step.

2. The method for supplying liquefied gases according to claim 1, wherein said at least one reservoir comprises a plurality of said reservoirs; and wherein in said filling step said liquefied gas is transferred from said plurality of said reservoirs to said at least one tank; and wherein in said pressurization step said boil-off of said liquefied gas in said at least one tank is introduced into said plurality of said reservoirs, thus minimizing refueling times.

* * * * *